US005433023A

United States Patent [19]

Edwards et al.

[11] Patent Number: 5,433,023

[45] Date of Patent: Jul. 18, 1995

[54] ARCHIVAL MOUNTING CORNER

[75] Inventors: William D. Edwards, Honeoye Falls; Dennis Inch, Fishers; Albrecht Wever, Bergen, all of N.Y.

[73] Assignee: LIght Impressions Corporation, Rochester, N.Y.

[21] Appl. No.: 20,261

[22] Filed: Feb. 18, 1993

Related U.S. Application Data

[63] Continuation of Ser. No. 833,736, Feb. 11, 1992, abandoned, which is a continuation-in-part of Ser. No. 650,063, Feb. 4, 1991, abandoned.

[51] Int. Cl.[6] ..... B44C 5/02

[52] U.S. Cl. ..... 40/159.1; 40/158.1

[58] Field of Search ..... 40/159.1, 158.1, 159

[56] References Cited

U.S. PATENT DOCUMENTS

| | | | |
|---|---|---|---|
| Re. 20,113 | 9/1936 | Zimmer | 40/159.1 |
| 1,220,354 | 3/1917 | Lodge | 40/159.1 |
| 1,852,744 | 4/1932 | Engel | 40/159.1 |
| 1,999,423 | 4/1935 | Riley | 40/159.1 |
| 2,068,909 | 1/1937 | Engel | 40/159.1 |
| 2,085,187 | 6/1937 | Engel | 40/159.1 |
| 2,292,582 | 8/1942 | Tate | 40/159.1 X |
| 2,360,693 | 10/1944 | Lartz | 40/159.1 |
| 2,534,919 | 12/1950 | Lartz | 40/159.1 |
| 3,023,678 | 3/1962 | Tschentschel | 40/159.1 X |
| 3,346,979 | 10/1967 | Milos | 40/159.1 |

*Primary Examiner*—Kenneth J. Dorner
*Assistant Examiner*—Milton Nelson, Jr.
*Attorney, Agent, or Firm*—Cumpston & Shaw

[57] ABSTRACT

An archival mounting corner having a pocket for releasably securing a primary sheet relative to a secondary sheet. The pocket opening is defined by substantially parallel walls wherein one wall includes a non-parallel region. The mounting corner includes a base member defining one wall and a pocket member defining the remaining wall, wherein the base member includes a recess at least partially occluded by a pocket member. The mounting corner is formed of an inert material having an adhesive pad circumscribed by the periphery of the mounting corner.

4 Claims, 2 Drawing Sheets

ARCHIVAL MOUNTING CORNER

This is a continuation of U.S. Ser. No. 07/833,736, filed Feb. 11, 1992, which is a continuation-in-part of U.S. Ser. No. 07/650,063 filed Feb. 4, 1991, both now abandoned.

The present invention relates to mounting corners for releasably retaining a primary sheet relative to a secondary sheet, and more particularly, to an inert archival mounting corner configured to facilitate engagement of the mounting corner and the primary sheet. Specifically, the mounting corner includes a pocket substantially defined by parallel walls which are separated by a given distance, wherein one wall includes one of an aperture and spaced apart region, wherein the spaced apart region is separated from the remaining wall by a distance greater than the given distance.

BACKGROUND OF THE INVENTION

Archival mounting corners are used for the non-destructive releasable retention of a primary sheet, such as a photograph or document, relative to a secondary sheet, such as a page of an album or book. The mounting corner includes a pocket for receiving a portion of the primary sheet and a base for securing to the secondary sheet. The mounting corner is affixed to the secondary sheet by an adhesive on the underside of the base. The adhesive covers the entire underside of the base. The adhesive may be a variety of types, including self-adhering, or wettable adhesives.

Although the use of an adhesive on the entire underside of the base provides for efficient manufacturing techniques, the presence of the adhesive proximal to the periphery of the mounting corner presents subsequent problems. Specifically, as the adhesive has an inherent flow rate, the adhesive gradually flows, or creeps, from between the mounting corner and the secondary sheet to contact the primary sheet. Any contact of the adhesive and the primary sheet may substantially damage the primary sheet.

The construction of the mounting corner also affects the integrity of the primary sheet. Mass manufacturing processes employ a vinyl or polyethylene coated polyester. Although these materials are readily heat bonded, they tend to degrade the primary sheet over extended periods of time. Polyester is a preferred material, as it provides a completely inert interface with the primary sheet. However, polyester does not exhibit broad tolerances in the preferred thermal bonding manufacturing techniques. Therefore, polyester is not employed for mass manufacturing mounting corners.

In addition, prior mounting corners are difficult to engage with the primary sheet. Many mounting corners require flexing or bending of the corner to allow engagement with the primary sheet.

Therefore, a need exists for an archival mounting corner formed of a completely inert material, such as uncoated polyester. A need also exists for a mounting corner which may be affixed to a secondary sheet such that inherent flow of the adhesive does not extend beyond the periphery of the corner. A further need exists for facilitating engagement of the mounting corner and the primary sheet.

SUMMARY OF THE INVENTION

A polyester archival mounting corner having a circumscribed adhesive pad is disclosed.

Preferably, the mounting corner includes an uncoated polyester base member, an uncoated polyester pocket member and an adhesive pad. The base member has a first and a second planar surface defined by a periphery. The pocket member is sized to overlie a portion of the base member and is thermally bonded to the base member to form a pocket. The pocket has an opening defined by the substantially parallel portions of the base and pocket member.

The adhesive pad is affixed to the second planar surface of the base member. The periphery of the adhesive pad is less than the periphery of the base member so that the pad is circumscribed by a sufficient distance of the second planar surface so that the flow of the adhesive due to its inherent flow rate will not pass beyond the periphery of the base member.

The present mounting corner also includes one of the aperture and spaced apart region in the pocket opening for permitting engagement of the primary sheet and the mounting corner. The one of the aperture and the spaced apart region may be formed in the base member, such that the base member includes a recess or aperture, and the unbonded, or free edge of the pocket overlies, or intersects the periphery of the recess or aperture. To engage the mounting corner, the corner of the primary sheet is disposed in the recess or aperture and then introduced into the pocket formed between the pocket member and the base member.

DETAILED DESCRIPTION OF THE PREFERRED EMBODIMENTS

Figure 1:
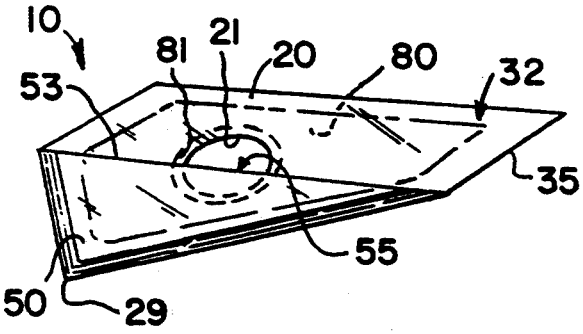
FIG. 1 is a perspective view of the mounting corner of the present invention.

Referring to FIG. 1, an archival mounting corner 10 having a base member 20, a pocket member 50, and an adhesive pad 80 is disclosed.

Figure 3:
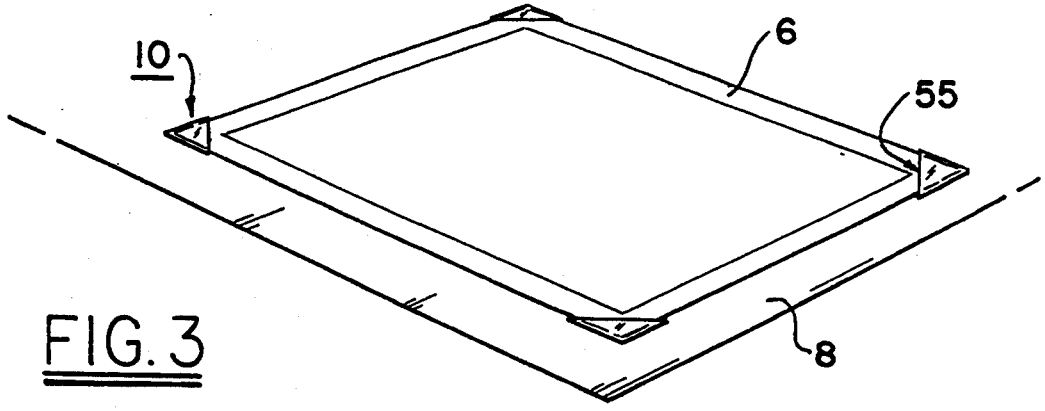
FIG. 3 is a perspective view showing the mounting corner retaining a primary sheet relative to a secondary sheet.

As shown in FIG. 3, the mounting corner 10 is used to retain a primary sheet 6 relative to a secondary sheet 8. The base member 20 may have any configuration which provides a sufficient contact area with the primary sheet 6 and the secondary sheet 8. Referring to FIGS. 1–4, the base member 20 preferably includes a rectangular section 22 and a triangular section 24, such that a side of the triangular section is coincident with a longitudinal side of the rectangular section. The remaining two sides of the triangular section 24 define non-parallel sides 25, 27 which intersect at an apex 29. Preferably, the non-parallel intersecting sides 25, 27 of the base member 20 are perpendicular. The rectangular section 22 may be a rectangle, or substantially square (not shown). Alternatively, the base member 20 may have any of a variety of peripheral configurations such as triangular, trapezoidal, or curvilinear.

The base member 20 has a first planar surface 32 and a second planar surface 34, defined by a periphery 35. Preferably, the base member 20 is formed of 5 mm thick uncoated polyester, such as Mylar® manufactured by E. I. dupont de Nemours and Company or Kodar PETG copolyester film manufactured by Eastman Kodak Company.

The pocket member 50 may be of any configuration complementary to the base member 20. Referring to FIGS. 1–5, the pocket member 50 is preferably a triangular piece of material and is the same size as the triangular section 24 of the base member 20. The periphery of the pocket member 50 is coincident with the periphery of the triangular section 24 of the base member 20.

Figure 4:
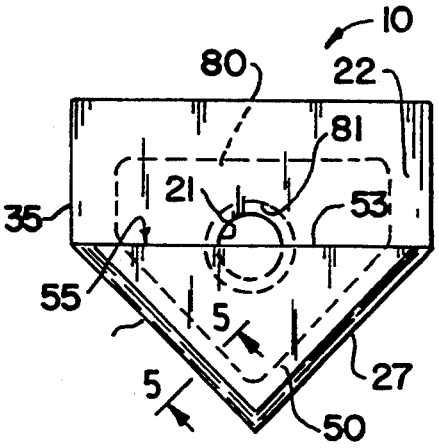
FIG. 4 is a top plan view of a mounting corner.
Figure 5:
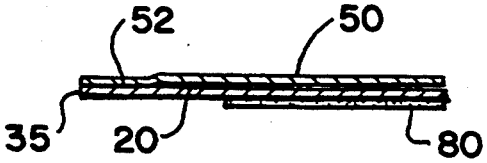
FIG. 5 is a cross-sectional view taken along lines 5—5 of FIG. 4.

Referring to FIGS. 4 and 5, the pocket member 50 is affixed by a thermal bond 52 to the peripheral edge of the triangular section 24 of the base member 20 along the non-parallel intersecting sides 25, 27. As shown in FIGS. 1, 3 and 4, the bonding of the pocket member 50 to the base member 20 forms a pocket 55 between the first planar surface 32 of the base member 20 and the pocket member 50. While shown as a separate piece, the pocket member 50 may be a portion of a continuous piece of material which also forms the base member 20. The pocket member 50 has an unbonded, or free edge 53 which partially defines the opening of the pocket 55. Preferably, the pocket member 50 is formed of 3 mm thick uncoated polyester such as Mylar® produced by E. I. dupont de Nemours and Company.

The base member 20 and the pocket member 50 thereby form pocket means for releasably engaging a portion of the primary sheet 6. That is, the pocket 55 has an opening defined by a pair of substantially parallel walls, wherein the pocket member 50 defines one wall and the first planar surface 32 of the base member 20 defines the second parallel wall. As shown in FIGS. 5, 7, 9 and 11, with respect to the cross section of the pocket opening, the bonding of the edges, or the joint between the base member 20 and pocket member 50 form the edges of the pocket 55. The parallel base and pocket member define parallel pocket walls.

Referring to FIGS. 1, 2, 4 and 5, the adhesive pad 80 is affixed to the second planar surface 34 of the base member 20. The peripheral configuration of the adhesive pad 80 is similar to the peripheral configuration of the base member 20, wherein the periphery defined by the adhesive pad 80 is less than the periphery 35 of the base member. The adhesive pad 80 is affixed to the second planar surface 34 of the base member 20, so that the periphery of the adhesive pad. 80 is circumscribed by a portion of the second planar surface 34 of the base member 20. That is, the periphery of the adhesive pad 80 is remote from the periphery 35 of the base member 20.

Preferably, the periphery of the adhesive pad 80 is separated from the periphery 35 of the base member 20 by a distance of at least 0.050 inches. The circumscribing portion of the base member 20, between the periphery of the adhesive pad 80 and the periphery 35 of the base member 20, is sufficient to prevent seepage of the adhesive from passing the periphery of the base member.

Preferably, the inherent flow rate of the adhesive is sufficiently small so that adhesive will not creep beyond the periphery 35 of the base member 20 during the period of use of the corner 10. Therefore, the distance between the periphery of the adhesive pad 80 and the periphery 35 of the base member 20 is partially determined by the anticipated life of the mounting corner 10, and the flow rate of the adhesive.

It is advantageous that the adhesive is an aggressive adhesive with respect to the composition of the base member. A preferred adhesive pad 80 is Adhesive No. 415 produced by Minnesota Manufacturing & Mining Company.

The pocket means of the present invention, has an opening defined by substantially parallel walls, wherein the walls are parallel to the major planar surface of the primary sheet 6. The pocket means includes the aperture and the spaced apart region.

Figure 2:
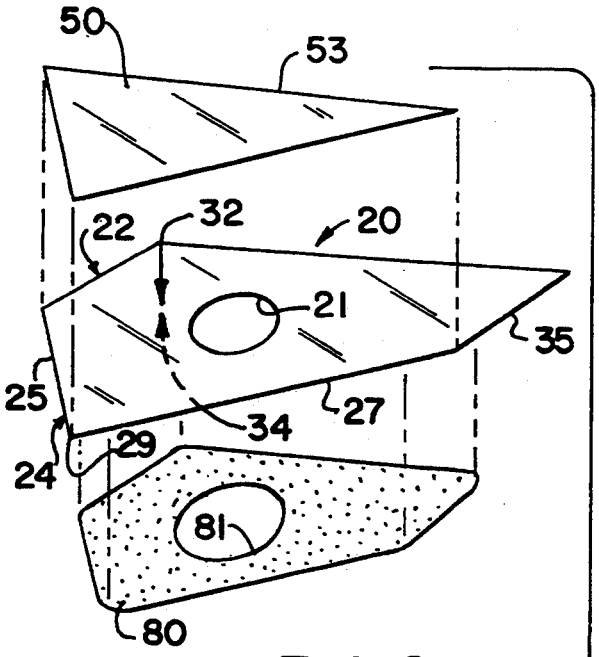
FIG. 2 is an exploded perspective view of the components of the present invention.

Referring, to FIG. 2, as the aperture extends through the base member 20, the adhesive pad 80 includes a corresponding aperture 81. The periphery of the aperture 81 is set back from the periphery of the aperture 21 by a sufficient distance to ensure that the natural creep of the adhesive does not reach the aperture 21 and contact the primary sheet 6.

Alternatively, the mounting corner 10 may be formed to have a recess 23 in the base member 20 such that the pocket member 50 intersects the periphery of the recess. That is, the free edge 53 overlies a portion of the recess 23. The recess 23 may be formed by etching or reducing a portion of the first planar surface 32.

Figure 6:
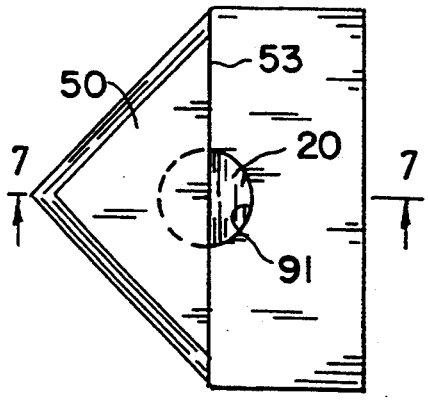
FIG. 6 is a top plan view of an alternative embodiment.
Figure 7:
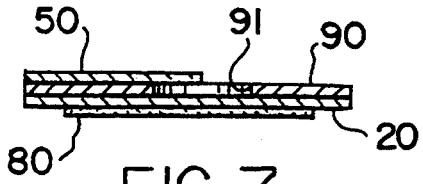
FIG. 7 is a cross sectional view taken along lines 7—7 of FIG. 6.

Referring to FIGS. 6 and 7, the aperture or spaced apart region may be effectively formed by increasing the relative thickness of the surrounding area of the base member 20. A spacer layer 90 having an aperture 91 may be affixed to the base member 20 so as to be disposed between the base member and the pocket member 50. The free edge 53 of the pocket member 50 overlies a portion of the aperture 91.

Figure 8:
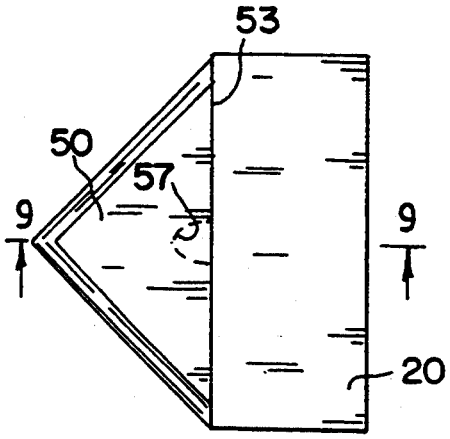
FIG. 8 is a top plan view of an alternative embodiment.
Figure 9:
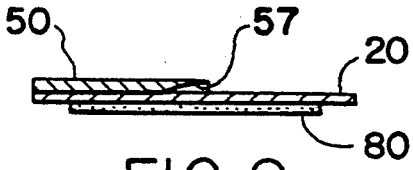
FIG. 9 is a cross sectional view taken along lines 9—9 of FIG. 8.

An alternative embodiment is shown in FIGS. 8 and 9, wherein the pocket member 50 includes a tapered edge portion 57 which forms the spaced apart region in the pocket opening between the otherwise substantially parallel pocket member 50 and base member 20.

Figure 10:
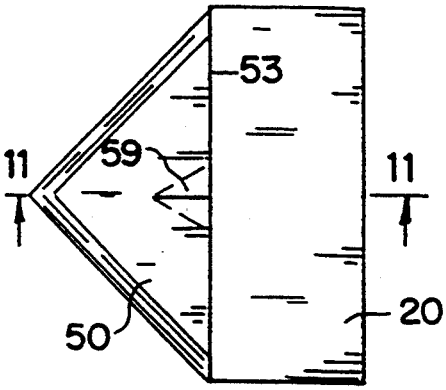
FIG. 10 is a top plan view of an alternative embodiment.
Figure 11:
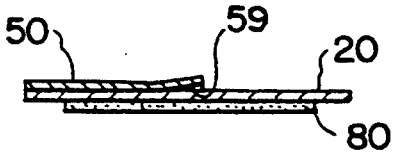
FIG. 11 is a cross sectional view taken along lines 11—11 of FIG. 10.

As shown in FIGS. 10 and 11, an alternative embodiment includes a crease 59 in the free edge 53. The fold of the crease 59 forms the spaced apart region between the base member 20 and the pocket member 50.

The aperture and spaced apart region region, including the aperture 21, or recess 23, may be any of a variety of configurations such as circular, oval, oblong, square or triangular. For each configuration, the aperture and spaced apart region region is intersected by the cross section of the opening of the pocket 55. This intersection may be accomplished by having the free edge 53 of the pocket member 50 intersect, or overlie, the periphery of the aperture 21 or recess 23.

The aperture and spaced apart region region allows simplified insertion of the primary sheet 6 into the mounting corner 10. To insert the primary sheet 6, the major planar surface of the primary sheet 6 is aligned parallel with the parallel walls of the pocket means. A corner of the primary sheet 6 is disposed in the aperture and spaced apart region region. Preferably, the aperture and spaced apart region region allows for a sufficient thickness of the primary sheet 6 to be disposed within the aperture and spaced apart region region so that the primary sheet 6 easily slides between the base member 20 and the pocket member 50. That is, the aperture and spaced apart region region in the cross sectional opening of the pocket 55 receives at least a portion of the thickness of the primary sheet 6, such that the remaining thickness of the primary sheet is less than the distance separating the parallel walls of the opening of the pocket.

The mounting corner 10 locates the corners of the primary sheet 6 relative to the secondary sheet 8. Initially, the desired location of a corner of the primary sheet 6 relative=to the secondary sheet 8 is determined. The mounting corner 10 is then affixed to the secondary sheet 8, so that the apex 29 of the pocket 55 is coincident with the desired location of the corner of the primary sheet 6.

Upon affixing the mounting corner 10 relative to the secondary sheet 8, the corner of the primary sheet 6 is flexed so that it contacts the first planar surface 32 of the rectangular portion 22 of the mounting corner 20. The coroner of the primary sheet 6 is then engaged with the pocket 55 until the corner of the primary sheet 6 is proximate to the apex 29 of the pocket 55. Alternatively, a mounting corner 10 may be disposed on each corner of the primary sheet 6. The primary sheet 6 is then aligned relative to the secondary sheet 8, and the mounting corners 10 are pressed to the secondary sheet 8, so the adhesive pads 80 adhere to the secondary sheet.

METHOD OF MANUFACTURE

The disclosed archival mounting corner 10 is preferably formed in a continuous operation. The base member 20 and the pocket member 50 are formed from webs of uncoated polyester. Similarly, the adhesive pad 80 is formed from a continuous web of adhesive.

The webs from which the base member 20 and the pocket member 50 are formed are preheated to a temperature of approximately 170° F.±2° F. The pocket member 50 is aligned with the base member 20. The peripheral edge of the base member 20 and the pocket member 50 are heated to a sealing temperature of approximately 290° F.±2° F., and contacted for approximately 2.5 seconds, to thermally bond the periphery of the pocket member 50 to the base member 20.

The bonded webs are cut to define the outer periphery 36 of the base member 20 and the pocket member 50.

The adhesive web is cut to form the individual pads 80. The base member 20 and the adhesive pad 80 are then aligned, so that the periphery of the adhesive pad is remote from the periphery 35 of the base member. The adhesive pad 80 then contacts the second planar surface 34 of the base member 20, and is affixed thereto.

The formation of the aperture 21 in the base member 20, and the aperture 81 in the adhesive pad 80 is initiated prior to bonding of the components.

If the base member is formed with a recess 23, the recess may be formed by abraiding or gouging the first planar surface 32. Alternatively, the recess 23 may be efficiently formed by disposing the spacer layer 90 between the base member 20 and the pocket member 50 and then bonding the multiple layers together.

The tapered edge portion 57 may be formed in the pocket member 50 during manufacturing of the stock from which the pocket member is cut. The crease 59 may be mechanically formed in the pocket member 50 prior subsequent to bonding to the base member 20.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. An archival mounting corner for non-adhesively releasably retaining a primary sheet relative to a secondary sheet, comprising:

(a) non-adhesive pocket means for non-adhesively releasably engaging the mounting corner with a portion of the primary sheet, the pocket means having a pocket opening defined by a pair of substantially parallel opposed walls separated by a given distance, the parallel opposed walls defining the entire pocket opening, wherein one opposed wall includes a spaced apart region such that the spaced apart region is bounded by portions of the one opposed wall that are separated from the remaining opposed wall by the given distance; and (b) an adhesive pad affixed to the mounting corner remote from the non-adhesive pocket means for affixing the mounting corner relative to the secondary sheet:

wherein the pocket means comprises a planar base member forming one of the parallel opposed walls and a pocket member overlying the base member to form a pocket therebetween for receiving a portion of the primary sheet, the pocket member defining the remaining one of the parallel opposed walls.

2. An archival mounting corner for releasably retaining a primary sheet relative to a secondary sheet, comprising:

(a) a base member having a first planar surface and a second planar surface defined by a periphery, the base member including an aperture within the periphery;

(b) a pocket member overlying a portion of the first planar surface to form a pocket therebetween for non-adhesively receiving a portion of the primary sheet, such that the pocket member overlies a portion of the aperture; and (c) an adhesive pad affixed to the second planar surface for retaining the mounting corner relative to the secondary sheet wherein the adhesive pad includes an aperture having a larger periphery than the aperture in the base member.

3. An archival mounting corner for non-adhesively releasably retaining a primary sheet relative to a secondary sheet, comprising:

(a) a base member having a first surface for contacting a portion of the primary sheet, and an aperture therein; and (b) a pocket member attached to the base member wherein substantially the entire pocket member directly overlies the base member to form a non-adhesive pocket therebetween, the pocket member partially overlying the aperture to define a spaced apart region in the pocket opening such that upon insertion of the primary sheet into the pocket, the primary sheet is intermediate of the base member and the pocket member.

4. The archival mounting corner of claim 3, further comprising an adhesive pad affixed to a second surface of the base member to affix the mounting corner to the secondary sheet.

* * * * *